US010453663B2

(12) United States Patent
Murakami et al.

(10) Patent No.: US 10,453,663 B2
(45) Date of Patent: Oct. 22, 2019

(54) MASS SPECTROMETRY DEVICE AND ION DETECTION METHOD THEREFOR

(71) Applicant: HITACHI HIGH-TECHNOLOGIES CORPORATION, Minato-ku, Tokyo (JP)

(72) Inventors: Shinichi Murakami, Tokyo (JP); Yasushi Terui, Tokyo (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 0 days.

(21) Appl. No.: 16/069,066

(22) PCT Filed: Jan. 21, 2016

(86) PCT No.: PCT/JP2016/051636
§ 371 (c)(1),
(2) Date: Jul. 10, 2018

(87) PCT Pub. No.: WO2017/126067
PCT Pub. Date: Jul. 27, 2017

(65) Prior Publication Data

US 2019/0027350 A1 Jan. 24, 2019

(51) Int. Cl.
*H01J 49/00* (2006.01)
*H01J 49/02* (2006.01)
*H01J 49/42* (2006.01)

(52) U.S. Cl.
CPC ..... *H01J 49/025* (2013.01); *H01J 49/0009* (2013.01); *H01J 49/0036* (2013.01); *H01J 49/4215* (2013.01)

(58) Field of Classification Search
CPC .. H01J 49/025; H01J 49/0009; H01J 49/4215; H01J 49/0036
(Continued)

(56) References Cited

U.S. PATENT DOCUMENTS 4,766,312 A * 8/1988 Fergusson ..... H01J 49/025 250/281
2008/0046194 A1* 2/2008 Antonov ..... H01J 49/0027 702/27

FOREIGN PATENT DOCUMENTS

JP 63-50749 A 3/1988
JP 01-298637 A 12/1989
(Continued)

OTHER PUBLICATIONS

Chinese Office Action dated May 15, 2019 for CN Application No. 201680076701.0 (with English Translation).

*Primary Examiner* — Michael Maskell
(74) *Attorney, Agent, or Firm* — Miles & Stockbridge, P.C.

(57) ABSTRACT

An object of the invention is to provide a mass spectrometry device and an ion detection method therefor in which an ion amount can be detected with high accuracy.

In order to achieve the object described above, a mass spectrometry device is provided which performs a channel scan measurement by changing a voltage to be applied to a mass separation unit to selectively extract a desired ion. The mass spectrometry device includes: an ion detection unit which detects an ion separated by the mass separation unit and outputs an electric signal; an ion amount measuring unit which measures an ion amount from the output of the ion detection unit; and an ion amount correction unit which corrects a detection amount of ion from an output of the ion amount measuring unit. In a process of a channel scan, the ion amount correction unit performs correction of a detection amount of ion detected in a present channel based on a detection amount of ion in a previous channel.

15 Claims, 5 Drawing Sheets

(58) Field of Classification Search
USPC ..... 250/281, 282, 288
See application file for complete search history.

(56) References Cited

FOREIGN PATENT DOCUMENTS

| | | | | |
|---|---|---|---|---|
| JP | 1-298637 | A | | 12/1989 |
| JP | 01298637 | A | * | 12/1989 |
| JP | 02-163651 | A | | 6/1990 |
| JP | 63-318062 | A | | 12/1998 |
| JP | 2011-102714 | A | | 5/2011 |

* cited by examiner

[FIG. 1]
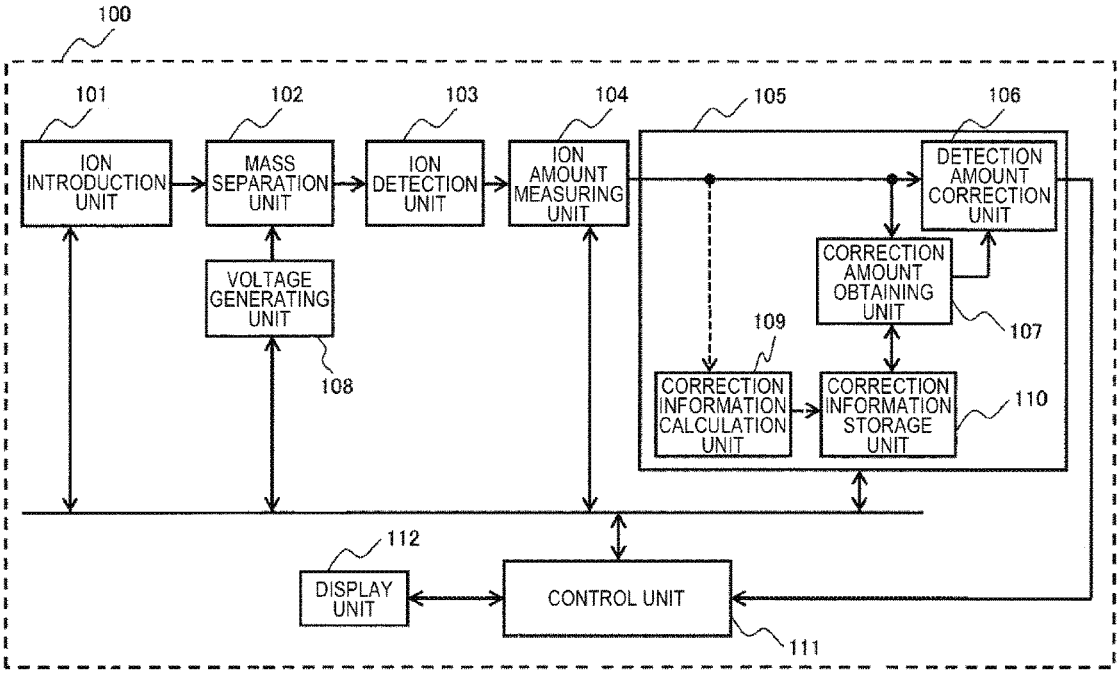
[FIG. 2]
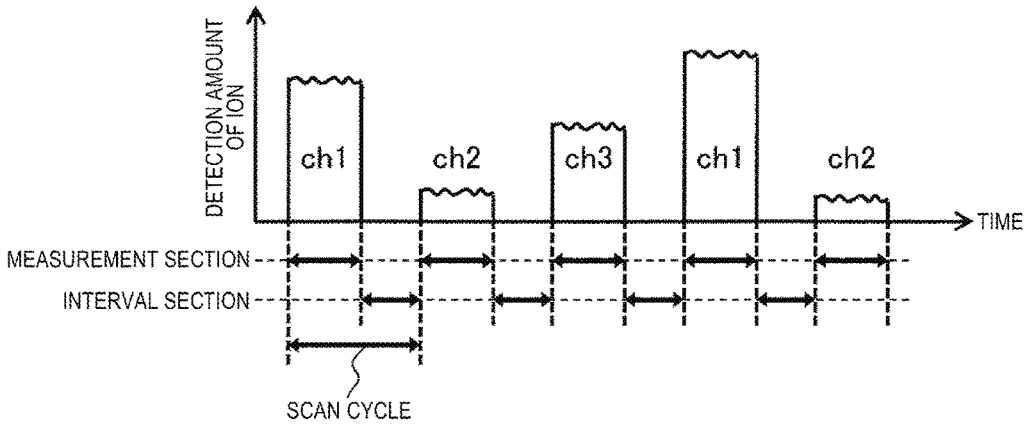

[FIG. 3]
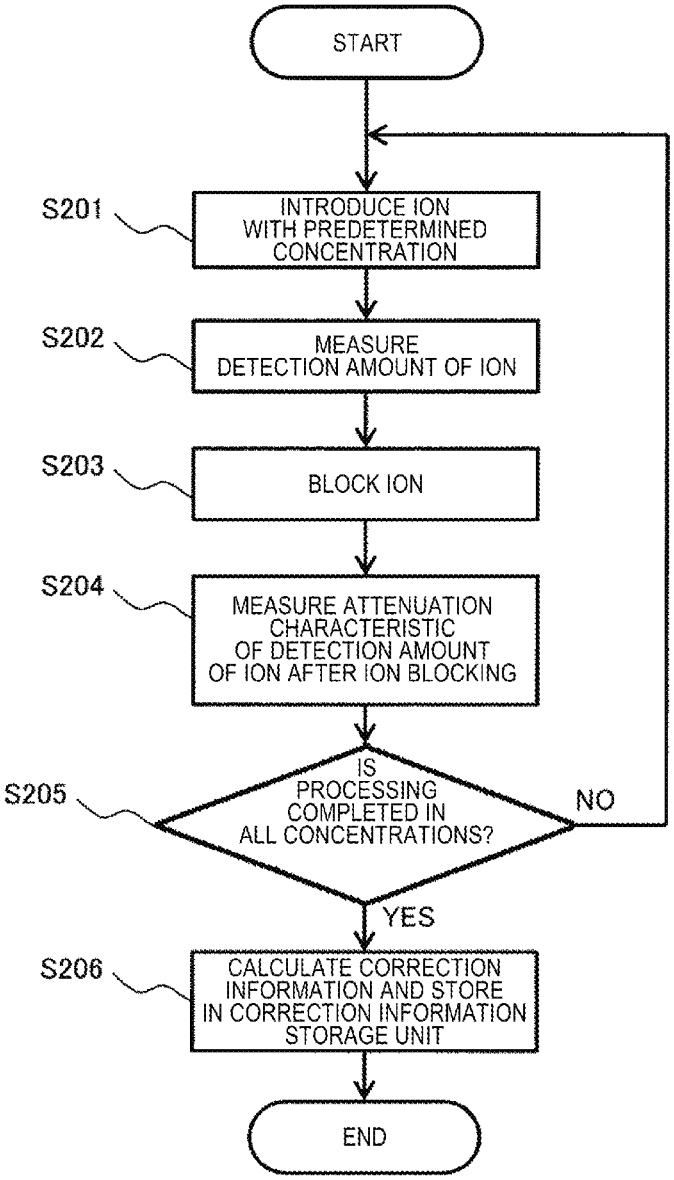

[FIG. 4]
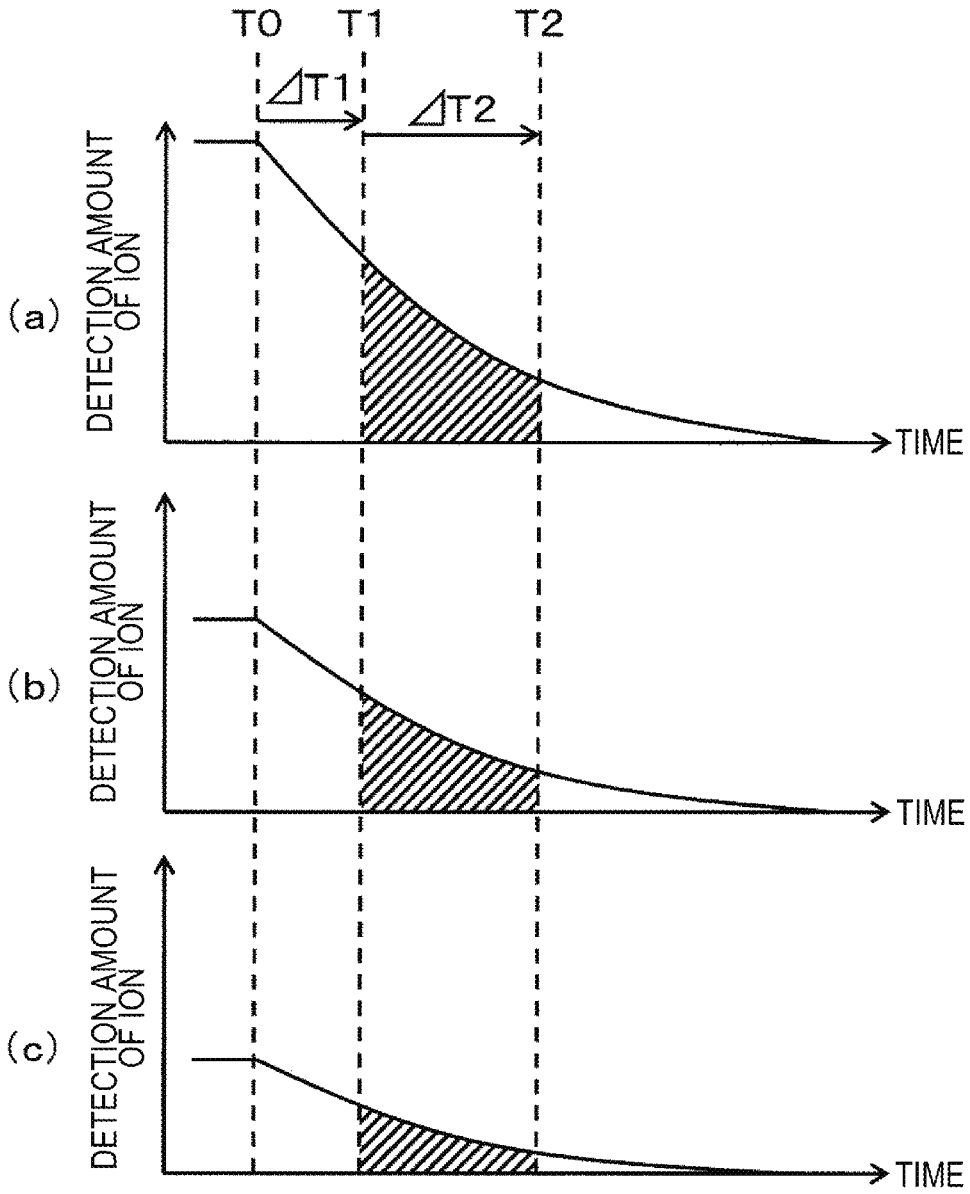

[FIG. 5]
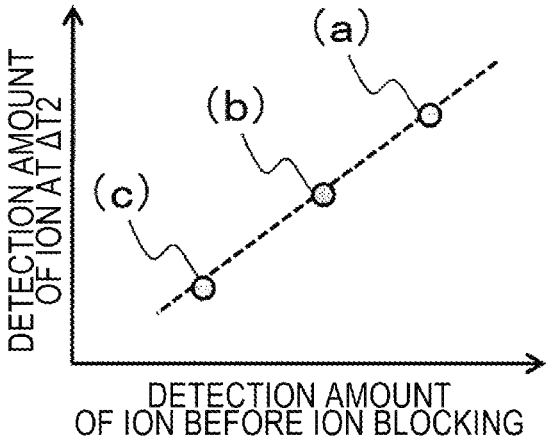
[FIG. 6]
| [MEASUREMENT TIME, INTERVAL] | $\alpha$ | $\beta$ |
|---|---|---|
| [5ms, 5ms] | 9.00 | 0.12 |
| [5ms, 7ms] | 1.02 | 0.51 |
| [5ms, 10ms] | 0.05 | 0.34 |
| ... | ... | ... |
| ... | ... | ... |

[FIG. 7]
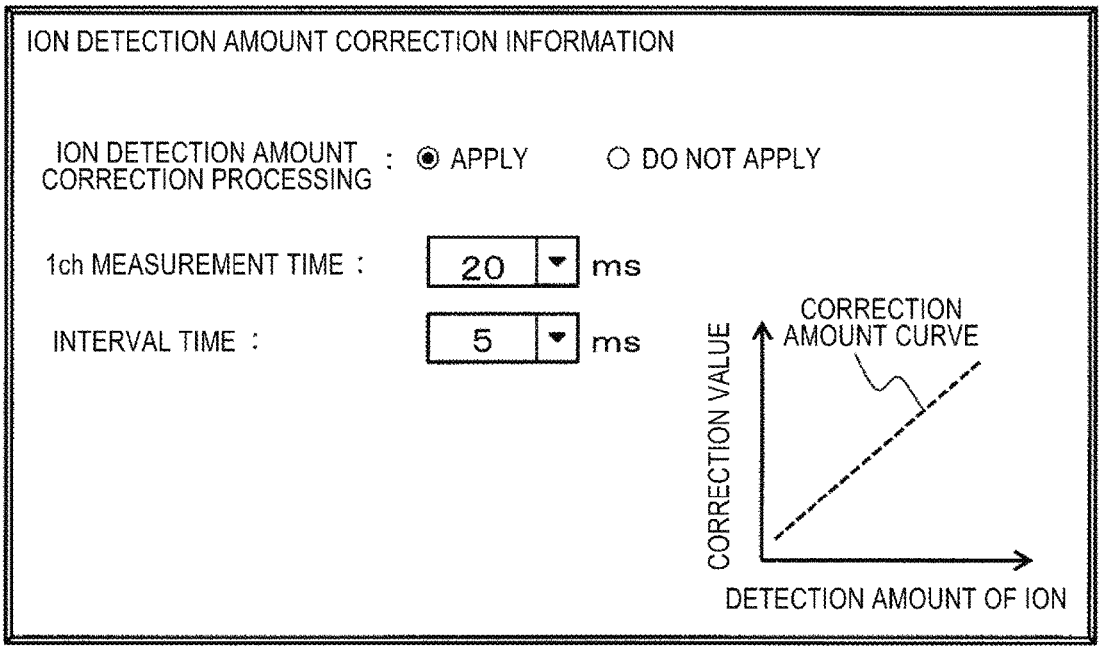
[FIG. 8]
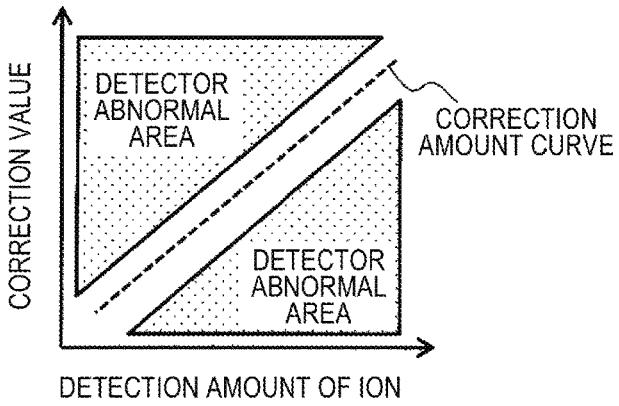

MASS SPECTROMETRY DEVICE AND ION DETECTION METHOD THEREFOR

TECHNICAL FIELD

The present invention relates to a mass spectrometry device and an ion detection method therefor.

BACKGROUND ART

As a background art in this technical field, there is disclosed in JP-A-2011-102714 (PTL 1). PTL 1 describes that "a noise detection process during a cycle for a MS spectrum collection is provided so that an ion detection signal is compared with the detected noise so as to remove the noise and to remove the neutral particle noise corresponding to the fluctuation of a sample and a carrier gas which are changed during the measurement". In addition, it is described that "a noise component can be removed by performing a comparison operation between the signal and the noise which are detected during a spectrum acquisition period and a noise acquisition period.

CITATION LIST

Patent Literature

SUMMARY OF INVENTION

Technical Problem

A quadrupole mass spectrometer which uses a quadrupole mass filter as a mass spectrometry device is one of the mass spectrometry device which is used most widely due to a relatively low price and a small size. The quadrupole mass spectrometer is configured by four columnar electrodes. The columnar electrodes are combined by providing a circular center in a transverse section in a quadratic apex. When a DC voltage and an AC voltage on positive and negative sides are respectively applied in superimposed state to the adjacent electrodes of the fixed columnar electrodes, an ion with electric charges passes through the columnar electrode while vibrating, and only specific ion passes through the electrode while vibrating stably according to the voltage and the frequency. On the other hand, the vibration of other ions is enlarged while passing through the electrode, so that the ions cannot pass through the electrode due to collision. When the AC voltage is changed while stably keeping the ratio between the DC voltage and the AC voltage, only an ion with a specific mass-to-charge ratio (m/z) can pass through the quadrupole mass filter and the ion amount with respect to a predetermined mass-to-charge ratio can be collected.

A type which directly detects the ion passing through the quadrupole mass filter by using a secondary electron multiplier configured by a multistep-type dynode or a detecting type which uses a scintillator which can detect the ions having large mass with a proper sensitivity is adopted as a detecting method of ions in the mass spectrometry device. In the detecting type which uses the scintillator, first, the ion passing through the quadrupole mass filter collides with a conversion dynode (CD). Next, an electron emitted from the surface of the CD collides with the scintillator to be converted to the light, which is detected by a photomultiplier tub. The configuration of the directly-detecting type of the former is simple, and the scintillator type of the latter is excellent in terms of high sensitivity and long life.

The related art described in PTL 1 describes the removal of the neutral particle noise corresponding to the fluctuation of the sample and the carrier gas which are changed during the measurement. However, the noise component which is caused by the characteristic of the ion detector is not considered.

Particularly, in a channel scan measurement, for example, in a case where a channel 1 having a large detection amount of ion is switched to a channel 2 having a small detection amount of ion, ion amount detection accuracy of a low concentration channel is lowered by a crosstalk from a high concentration channel. In the scintillator type, the remaining light of the scintillator due to the incident electron of the channel 1 affects the measurement section of the channel 2, and the component of the remaining light of the channel 1 is added to the detection amount of ion of the channel 2, whereby the ion detection accuracy of the channel 2 is lowered. In addition, several ms to several tens of ms are required to block the incident electron to the scintillator and to attenuate and stop the emission of the scintillator. For this reason, in the case of the related art in which the noise is properly measured during the scan cycle, it is difficult to perform noise amount detection including the attenuation process, which is problematic. In addition, also in the case of the directly-detecting type, the same problem may occur when a measurement interval is shortened further.

An object of the invention is to provide a mass spectrometry device and an ion detection method therefor in which detection accuracy of an ion amount can be improved by removing erroneous detection of an ion due to a crosstalk from another channel.

Solution to Problem

In order to solve the above problem, as one example of the invention, a mass spectrometry device is provided which performs a channel scan measurement by changing a voltage to be applied to a mass separation unit to selectively extract a desired ion. The mass spectrometry device includes: an ion detection unit which detects an ion separated by the mass separation unit and outputs an electric signal; an ion amount measuring unit which measures an ion amount from the output of the ion detection unit; and an ion amount correction unit which corrects a detection amount of ion from an output of the ion amount measuring unit. In a process of a channel scan, the ion amount correction unit performs correction of a detection amount of ion detected in a present channel based on a detection amount of ion in a previous channel.

Advantageous Effects of Invention

According to the invention, the mass spectrometry device and the ion detection method therefor can be provided in which the ion amount can be detected with high accuracy. A problem, a configuration, and an effect which are not described above will be clarified by the following description of an embodiment.

BRIEF DESCRIPTION OF DRAWINGS

FIG. 1 is a block diagram illustrating one example of a configuration of a mass spectrometry device in this embodiment.

FIG. 2 is an operating sequence of a channel scan measurement in this embodiment.

FIG. 3 is a flowchart illustrating an obtaining method of correction information in this embodiment.

FIG. 4 is a graph illustrating one example of a fluctuation of a detection amount of ion at the time of ion blocking in this embodiment.

FIG. 5 is a graph illustrating one example of a relation between the detection amount of ion before the ion blocking and the detection amount of ion at a section ΔT2 in this embodiment.

FIG. 6 is one example of a database stored in a correction information storage unit in this embodiment.

FIG. 7 is one example of ion detection amount correction information which is displayed in a display unit in this embodiment.

FIG. 8 is one example of a displaying method of a correction amount curve in this embodiment.

DESCRIPTION OF EMBODIMENTS

Hereinafter, an embodiment of the invention will be described by using the drawings.

Embodiment

FIG. 1 is a block diagram illustrating a configuration of a mass spectrometry device 100 in this embodiment. In FIG. 1, a measurement sample generated by pretreatment with such as a gas chromatograph or a liquid chromatograph or a measurement sample supplied by another method is ionized in such a manner that the electric charge is applied to the measurement sample in an ion introduction unit 101. An electrospray ionization (ESI), an atmospheric chemical ionization (APCI), an electron ionization (EI), or a chemical ionization (CI) is considered as a method of the ionization, and the ionization method is selected according to the property of the measurement sample.

The ionized measurement sample is separated according to the mass-to-charge ratio (m/z) of the ion in a mass separation unit 102. Herein, "m" indicates the mass of the ion, and "z" indicates the electrification valence of the ion. The mass separation unit 102 is a quadrupole mass spectrometer configured by four columnar electrodes. In the adjacent electrodes of the fixed columnar electrodes, by changing the AC voltage while stably keeping the ratio between the DC voltage and the AC voltage, only the ion having a specific mass-to-charge ratio (m/z) passes through the quadrupole mass filter. The DC voltage and the AC voltage applied to the quadrupole mass spectrometer are supplied by a voltage generating unit 108.

Incidentally, the mass separation unit 102 may have a configuration having a higher mass selectivity, such as a triple quadrupole mass spectrometer configured by three quadrupole mass spectrometers. In the triple quadrupole mass spectrometer, first, only the specific ion derived from the measurement sample is extracted by the first quadrupole mass spectrometer. Next, the extracted ion is collided with a gas or the like by a second quadrupole mass spectrometer so as to be dissociated, whereby a fragment ion is generated. Further, the fragment ion is subject to a mass separation by a third quadrupole mass spectrometer, so that only target ion components can pass therethrough. In the case of the triple quadrupole mass spectrometer, the proper DC voltage and AC voltage are applied to each of the first to third quadrupole mass spectrometers by the voltage generating unit 108 so that only the target ion components pass through the quadrupole mass filter.

The ion passing through the mass separation unit 102 is supplied to an ion detection unit 103. The ion detection unit 103 includes a conversion dynode which emits the secondary electron by the collision of the ion, a scintillator which makes the secondary electron emitted from the conversion dynode incident to be converted into light, and a photodetector which detects the output light of the scintillator. The ion becomes a pulse-shaped electric signal (hereinafter, a pulse signal) and is output to an ion amount measuring unit 104. Incidentally, the ion detection unit 103 may be configured to be a type which directly detects a secondary electron ion by using the photodetector without the scintillator.

In the ion amount measuring unit 104, the number of the received pulse signals or the total sum of the strength (area) of the pulse signal is calculated at a predetermined interval (for example, 1 us, 10 us, and 100 us) to be output to an ion amount correction unit 105.

The ion amount correction unit 105 includes a detection amount correction unit 106, a correction amount obtaining unit 107, a correction information calculation unit 109, and a correction information storage unit 110. The detection amount of ion supplied from the ion amount measuring unit 104 is subject to a correction processing (to be described) to be output to a control unit 111.

The control unit 111 performs various data analysis processings by using the received detection amount of ion to output an analysis result represented by a mass spectrum or the like to a display unit 112 configured by a monitor screen and the like.

Next, the description will be given about an operating sequence of a channel scan measurement which is a premise of this embodiment. FIG. 2 illustrates an aspect of the channel scan measurement which repeatedly detects the ion amount with respect to three types of the ion by time division. One scan cycle is configured by a measurement section of one channel and an interval section, and a measurement time of the measurement section and an interval time of the interval section are parameters which can be decided by a user.

In the mass spectrometry device 100 of this embodiment, before the measurement is performed, it is necessary to calculate and store the correction information required for the correction of the detection amount of ion. Hereinafter, the description will be given about the operation for obtaining the correction information executed by the control unit 111.

The control unit 111 supplies a plurality of measurement samples having different approximate concentrations (for example, 1 ppb, 10 ppb, 100 ppb, 1 ppm, 10 ppm, and 100 ppm) to the mass separation unit 102 by the ion introduction unit 101, obtains the attenuation characteristic of the detection amount of ion which is measured in the ion amount measuring unit 104 at the time of blocking the supply of the ion to the ion detection unit 103 with respect to the measurement samples having respective concentrations, and calculates the correction information based on the obtained result.

FIG. 3 is a flowchart illustrating an obtaining method of the correction information in the mass spectrometry device 100 of this embodiment. In FIG. 3, first, the control unit 111 introduces the measurement sample for obtaining the correction information to the mass separation unit 102 by the ion introduction unit 101 (S201). The correction information calculation unit 109 obtains the ion amount detected in the ion amount measuring unit 104 at this time (S202). Next, the control unit 111 applies the voltage which all the ions block (do not pass through) in the mass separation unit 102 with respect to the voltage generating unit 108, and blocks the supply of the ion to the ion detection unit 103 (S203). The ion amount measuring unit 104 starts to measure the ion amount at the timing when the mass separation unit 102 blocks the ion, and obtains the ion amount which is measured in the correction information calculation unit 109 at a predetermined time (for example, 100 ms) (S204). Further, similarly, the control unit 111 executes the processing on the measurement sample having another concentration (S205). As a result, in the correction information calculation unit 109, the attenuation characteristic of the detection amount of ion at the time of blocking the ion is obtained in each of the measurement samples having the concentrations, the information is used to calculate correction information, and the correction information is stored in the correction information storage unit 110 (S206).

Next, a calculating method of the correction information will be described by using FIGS. 4 to 6.

FIG. 4 is a graph illustrating a time fluctuation of the detection amount of ion which is received in the correction information calculation unit 109. FIG. 4(*a*) illustrates a case where the concentration of the measurement sample is high and the detection amount of ion before the ion blocking is large. FIG. 4(*c*) illustrates a case where the concentration of the measurement sample is low and the detection amount of ion is small. FIG. 4(*b*) illustrates the case of the detection amount of ion between (a) and (c). Herein, T0 in the drawings is the time when the ion is blocked, $\Delta T1=(T1-T0)$ is an interval time between the channels in the scan cycle, and $\Delta T2=(T2-T1)$ is a measurement time of one channel. In the mass spectrometry device 100 of this embodiment, in the measurement time of one channel and the interval time (hereinafter, measurement parameters), a plurality of combinations are provided, and the user can select one combination through the display unit 112. The correction information calculation unit 109 sets the section $\Delta T2$ decided at each of the measurement parameters and obtains the total sum of the detection amount of ion included in the section $\Delta T2$.

FIG. 5 is a graph illustrating a relation between the detection amount of ion before the ion blocking and the detection amount of ion at the section $\Delta T2$ in one measurement parameter. An approximate expression is calculated based on the measured measurement points (a, b, and c), and a coefficient information of the approximate expression is stored in the correction information storage unit 110. Herein, the detection amount of ion at the section $\Delta T2$ is a difference which affects the detection amount of ion of the next channel in the scan cycle, that is, a correction amount.

FIG. 6 is one example of the database stored in the correction information storage unit 110. In FIG. 6, the coefficient information ($\alpha$, $\beta$) of the approximate expression is stored with respect to all the measurement parameters. In this example, the relation between the detection amount of ion before the ion blocking illustrated in FIG. 5 and the detection amount of ion (correction amount) ay the section $\Delta T2$ is expressed by a linear approximation (the detection amount of ion at $\Delta T2=\alpha\times$the detection amount of ion before the blocking$+\beta$). However, the invention is not limited thereto. Further, a plurality of measurement points may be obtained by the measurement to be expressed by a curve approximation.

Next, the operation of the mass spectrometry device 100 in this embodiment will be described in a state where the correction information is formed as a database in the correction information storage unit 110 as described above. Incidentally, the measurement parameter before starting the measurement is selected based on the instruction from the user through the display unit 112.

In FIG. 1, in the ion introduction unit 101, the measurement sample is ionized to be supplied to the mass separation unit 102. In the mass separation unit 102, a proper voltage is applied by the voltage generating unit 108, and only the target ion components pass through the quadrupole mass filter. The ion passing through the mass separation unit 102 is supplied to the ion detection unit 103, and the ion is converted into the pulse-shaped electric signal (pulse signal) to be output to the ion amount measuring unit 104. In the ion amount measuring unit 104, the number of the pulse signals received in the measurement time of one channel or the total sum of the strength (area) of the pulse signal is calculated as the detection amount of ion and is output to the ion amount correction unit 105.

The detection amount of ion output by the ion amount measuring unit 104 is supplied to the detection amount correction unit 106 and the correction amount obtaining unit 107 included in the ion amount correction unit 105. In the correction amount obtaining unit 107, a correction value is obtained by the correction information storage unit 110 based on the received detection amount of ion to be output to the detection amount correction unit 106. Specifically, the coefficient information ($\alpha$, $\beta$) of the target measurement parameter is obtained with reference to the database (FIG. 6) stored in the correction information storage unit 110. Further, the correction value is calculated by using the approximate expression (the correction value$=\alpha\times$the detection amount of ion$+\beta$).

The detection amount correction unit 106 subtracts the correction value based on the detection amount of ion received by the ion amount measuring unit 104 and the detection amount of ion in the previous channel received by the correction amount obtaining unit 107, and supplies the subtraction result to the control unit 111. The control unit 111 performs various data analysis processings based on the received detection amount of ion, and outputs the analysis result such as the mass spectrum to the display unit 112 configured by the monitor screen or the like.

FIG. 7 is a display example illustrating the information relating to the correction processing of the detection amount of ion in the display unit 112. In FIG. 7, the measurement parameters (the measurement time of one channel and the interval time) are selected as well as the user can select whether the correction processing of the detection amount of ion is applied. The relation between (correction amount curve) between the detection amount of ion after the correction processing and the correction value can be illustrated to be presented to the user.

FIG. 8 is made by adding a detector abnormal area to the correction amount curve in FIG. 7. In FIG. 8, in a case where the operation of the ion detector is normal, the correction amount curve does not include the detector abnormal area. However, in a case where the correction result is obtained which includes the detector abnormal area as illustrated, it is determined whether the blocking characteristic of the ion amount is normal, and the user can be urged to inspect or exchange the ion detector. For example, the emission characteristic of the scintillator is changed due to the operation failure or the time deterioration of the scintillator, which is a cause of the detector abnormality.

Hereinbefore, before measurement, the mass spectrometry device of this embodiment stores the attenuation characteristic of the detection amount of ion at the time of the ion blocking in association with the detection amount of ion before the blocking in a plurality of ions having different concentrations. Further, at the time of the measurement, the mass spectrometry device is configured to subtract the correction value based on the detection amount of ion in the previous channel from the detection amount of ion of the present channel. Therefore, particularly, a problem can be avoided that in a case where the detection amount of ion is largely reduced by the channel switch, the ion detection accuracy of the present channel of the low concentration is lowered by the remaining pulse (mainly, results from the remaining light of the scintillator) by the high concentration channel in the previous channel. An accurate quantity measurement can be performed even in the low concentration channel.

As described above, in this embodiment, a mass spectrometry device is provided which performs a channel scan measurement by changing a voltage to be applied to a mass separation unit to selectively extract a desired ion. The mass spectrometry device includes: an ion detection unit which detects an ion separated by the mass separation unit and outputs an electric signal; an ion amount measuring unit which measures an ion amount from the output of the ion detection unit; and an ion amount correction unit which corrects a detection amount of ion from an output of the ion amount measuring unit. In a process of a channel scan, the ion amount correction unit performs correction of a detection amount of ion detected in a present channel based on a detection amount of ion in a previous channel.

An ion detection method of the mass spectrometry device is provided which performs a channel scan measurement by measuring an ion extracted by a mass separation. The method includes: correcting a detection amount of ion detected in a present channel of the ion extracted by the mass separation based on a detection amount of ion in the previous channel in a process of the channel scan.

A mass spectrometry device is provided which performs a channel scan measurement by measuring an ion extracted by a mass separation. The device includes: a set value input screen for selecting a measurement time of one channel and an interval time.

Accordingly, the mass spectrometry device and the ion detection method therefor can be provided in which the ion amount can be detected with high accuracy.

Incidentally, the invention is not limited to the above-described embodiment and includes various modifications. For example, the above-described embodiment is described in detail for easily explaining the invention, and the invention does not necessarily include all the configurations.

REFERENCE SIGNS LIST

100: mass spectrometry device
101: ion introduction unit
102: mass separation unit
103: ion detection unit
104: ion amount measuring unit
105: ion amount correction unit
106: detection amount correction unit
107: correction amount obtaining unit
108: voltage generating unit
109: correction information calculation unit
110: correction information storage unit
111: control unit
112: display unit

The invention claimed is:

1. A mass spectrometry device which performs a channel scan measurement by changing a voltage to be applied to a mass separation unit to selectively extract a desired ion, the device comprising:

an ion detection unit which detects an ion separated by the mass separation unit and outputs an electric signal;

an ion amount measuring unit which measures an ion amount from the output of the ion detection unit; and an ion amount correction unit which corrects a detection amount of ion from an output of the ion amount measuring unit, wherein in a process of a channel scan, the ion amount correction unit performs correction of a detection amount of ion detected in a present channel based on a detection amount of ion in a previous channel, and in the ion amount correction unit, an ion correction amount of the present channel is decided based on the detection amount of ion in the previous channel a measurement time of one channel, and an interval time required for a channel switch.

2. The mass spectrometry device according to claim 1, further comprising:

a correction information calculation unit which, for a plurality of measurement samples having different concentrations, measures an attenuation process of the detection amount of ion when ions are blocked and calculates the correction amount in association with the detection amount of ion before the ion blocking.

3. The mass spectrometry device according to claim 2, wherein the correction information calculation unit approximates a relation between the detection amount of ion before the ion blocking and the correction amount by an expression, and the device further includes a correction information storage unit which stores information of the derived approximate expression.

4. The mass spectrometry device according to claim 2, wherein the mass separation unit is a quadrupole mass filter, and the ion blocking is realized by controlling a voltage to be applied to the quadrupole mass filter.

5. The mass spectrometry device according to claim 1, wherein the ion detection unit includes a scintillator.

6. The mass spectrometry device according to claim 1, wherein said mass spectrometry device is configured to perform a channel scan measurement by measuring an ion extracted by a mass separation, and wherein the mass spectroscopy device further comprises a set value input screen for selecting a measurement time of one channel and an interval time.

7. The mass spectrometry device according to claim 1, further comprising:

an input setting screen for selecting whether to apply a correction processing which corrects the detection amount of the ion extracted by the mass separation in the process of the channel scan.

8. The mass spectrometry device according to claim 1, further comprising:

a display screen which displays a relation between the detection amount of ion and a correction value after the correction processing which corrects the detection amount of the ion extracted by the mass separation in the process of the channel scan.

9. A mass spectrometry device which performs a channel scan measurement by changing a voltage to be applied to a mass separation unit to selectively extract a desired ion, the device comprising:

an ion detection unit which detects an ion separated by the mass separation unit and outputs an electric signal;

an ion amount measuring unit which measures an ion amount from the output of the ion detection unit;

an ion amount correction unit which corrects a detection amount of ion from an output of the ion amount measuring unit; and a correction information calculation unit which, for a plurality of measurement samples having different concentrations, measures an attenuation process of the detection amount of ion when ions are blocked and calculates the correction amount in association with the detection amount of ion before the ion blocking, wherein in a process of a channel scan, the ion amount correction unit performs correction of a detection amount of ion detected in a present channel based on a detection amount of ion in a previous channel, the correction information calculation unit approximates a relation between the detection amount of ion before the ion blocking and the correction amount by an expression, and the device further includes a correction information storage unit which stores information of the derived approximate expression.

10. The mass spectrometry device according to claim 9, wherein in the ion amount correction unit, an ion correction amount of the present channel is decided based on the detection amount of ion in the previous channel, a measurement time of one channel, and an interval time required for a channel switch.

11. The mass spectrometry device according to claim 9, wherein the mass separation unit is a quadrupole mass filter, and the ion blocking is realized by controlling a voltage to be applied to the quadrupole mass filter.

12. The mass spectrometry device according to claim 9, wherein the ion detection unit includes a scintillator.

13. The mass spectrometry device according to claim 9, wherein said mass spectrometry device is configured to perform a channel scan measurement by measuring an ion extracted by a mass separation, and wherein the mass spectroscopy device further comprises a set value input screen for selecting a measurement time of one channel and an interval time.

14. The mass spectrometry device according to claim 9, further comprising:

an input setting screen for selecting whether to apply a correction processing which corrects the detection amount of the ion extracted by the mass separation in the process of the channel scan.

15. The mass spectrometry device according to claim 9, further comprising:

a display screen which displays a relation between the detection amount of ion and a correction value after the correction processing which corrects the detection amount of the ion extracted by the mass separation in the process of the channel scan.

* * * * *